US009022593B2

(12) United States Patent
Yang

(10) Patent No.: US 9,022,593 B2
(45) Date of Patent: May 5, 2015

(54) WATER LAMP WITH ROTARY STRUCTURE

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 63 days.

(21) Appl. No.: 13/802,753

(22) Filed: Mar. 14, 2013

(65) Prior Publication Data

US 2014/0268668 A1 Sep. 18, 2014

(51) Int. Cl.

| | |
|---|---|
| ***F21V 33/00*** | (2006.01) |
| ***F21S 10/00*** | (2006.01) |
| *F21W 121/00* | (2006.01) |
| *F21Y 101/02* | (2006.01) |

(52) U.S. Cl.

CPC ..... *F21S 10/002* (2013.01); *F21W 2121/00* (2013.01); *F21Y 2101/02* (2013.01)

(58) Field of Classification Search

CPC ..... F21V 3/0454; F21V 9/12; F21V 14/08; F21V 31/04; F21S 8/035; F21S 10/002; F21S 10/007

USPC ..... 362/101; 40/426

See application file for complete search history.

(56) References Cited

U.S. PATENT DOCUMENTS

| | | | | |
|---|---|---|---|---|
| 4,961,276 | A * | 10/1990 | Lin | 40/410 |
| 6,039,453 | A * | 3/2000 | Wang | 362/101 |
| 6,132,284 | A * | 10/2000 | Lin | 446/267 |
| 6,241,359 | B1 * | 6/2001 | Lin | 362/96 |
| 6,499,854 | B2 * | 12/2002 | Chen | 362/101 |
| 6,508,022 | B2 * | 1/2003 | Huang | 40/426 |
| 6,848,206 | B2 * | 2/2005 | Zhao | 40/406 |
| 6,877,883 | B2 * | 4/2005 | Lau Ting Yup et al. | 362/363 |
| 8,158,066 | B2 * | 4/2012 | Yang | 422/124 |
| 2003/0067764 | A1 * | 4/2003 | Lau Ting Yup et al. | 362/84 |
| 2004/0229541 | A1 * | 11/2004 | Liao et al. | 446/267 |
| 2004/0244243 | A1 * | 12/2004 | Tien | 40/410 |
| 2008/0025026 | A1 * | 1/2008 | Lee et al. | 362/253 |
| 2013/0148483 | A1 * | 6/2013 | Lagorgette | 368/228 |

* cited by examiner

*Primary Examiner* — Anh Mai
*Assistant Examiner* — Matthew J Peerce
(74) *Attorney, Agent, or Firm* — Leong C. Lei

(57) ABSTRACT

A water lamp comprises a main body, a rotary unit, and a base. The main body includes a transparent housing and a transparent bottom plate. The transparent housing is filled with slightly-viscous flowable liquid and sealed by the transparent bottom plate. The rotary unit is located within the transparent housing and includes an aesthetic object, a fixing block, a passive disk, and a central part. The passive disk is rotatably fitted over the central part and provided with a magnet. The base is provided with a lighting component, an active disk having one magnet corresponding to the magnet of the passive disk, and a driving device. The lighting component can emit light into the transparent housing. The driving device can rotate the active disk, which in turn can rotate the passive disk by using mutual attraction between the magnet of the active disk and the magnet of the passive disk.

3 Claims, 4 Drawing Sheets

WATER LAMP WITH ROTARY STRUCTURE

(a) TECHNICAL FIELD OF THE INVENTION

The present invention relates to a water lamp with a rotary structure and, more particularly, to a water lamp that can create a dynamic visual effect through a rotary structure that employs magnets.

(b) DESCRIPTION OF THE PRIOR ART

General ornaments, such as picture frames or dolls, are often placed on a desk for decoration. However, they only display a static beauty. To show a dynamic effect, a water lamp is a better choice for decoration, as it allows the water to be added with various objects to create a variety of visual effects. It is deserved for an ornament designer to take the time on the design of water lamp.

Accordingly, based on long-term experience of related works and constant test and modification, applicant has contrived a water lamp that can create a dynamic visual effect.

SUMMARY OF THE INVENTION

The primary object of the present invention is to provide a water lamp with a rotary structure, which can create a dynamic visual effect.

To achieve the above object, the water lamp may comprise a main body, a rotary unit, and a base. The main body includes a transparent housing and a transparent bottom plate, wherein the transparent housing is filled with slightly-viscous flowable liquid through a bottom opening portion thereof, and the transparent bottom plate is used to seal the bottom opening portion of the transparent housing. The rotary unit is located within the transparent housing and includes an aesthetic object, a fixing block, a passive disk, and a central part, wherein the central part is fixedly attached to the transparent bottom plate of the main body, the passive disk is rotatably fitted over the central part via a central opening thereof and provided with at least one magnet, and the aesthetic object is fixed to the fixing block that is in turn fixed to the central part so as to confine the passive disk between the fixing block and the central part. The base defines a top recess corresponding to the bottom opening portion of the transparent housing of the main body for mounting the main body. The base is provided with a lighting component facing towards the transparent bottom plate of the main body, an active disk having at least one magnet corresponding to the magnet of the passive disk, and a driving device connected to a center of the active disk, whereby the lighting component can emit light through the transparent bottom plate to enter the transparent housing of the main body, and the driving device can rotate the active disk, which in turn can rotate the passive disk by using mutual attraction between the magnet of the active disk and the magnet of the passive disk. As such, the water lamp can create a dynamic visual effect in addition to a brilliant visual effect.

Other objects, advantages, and novel features of the present invention will become more apparent from the following detailed description when taken in conjunction with the accompanying drawings.

DETAILED DESCRIPTION OF THE PREFERRED EMBODIMENTS

To allow the features and advantages of the present invention to be fully understood, one embodiment is illustrated in the following paragraphs with reference to the accompanying drawings.

Figure 1:
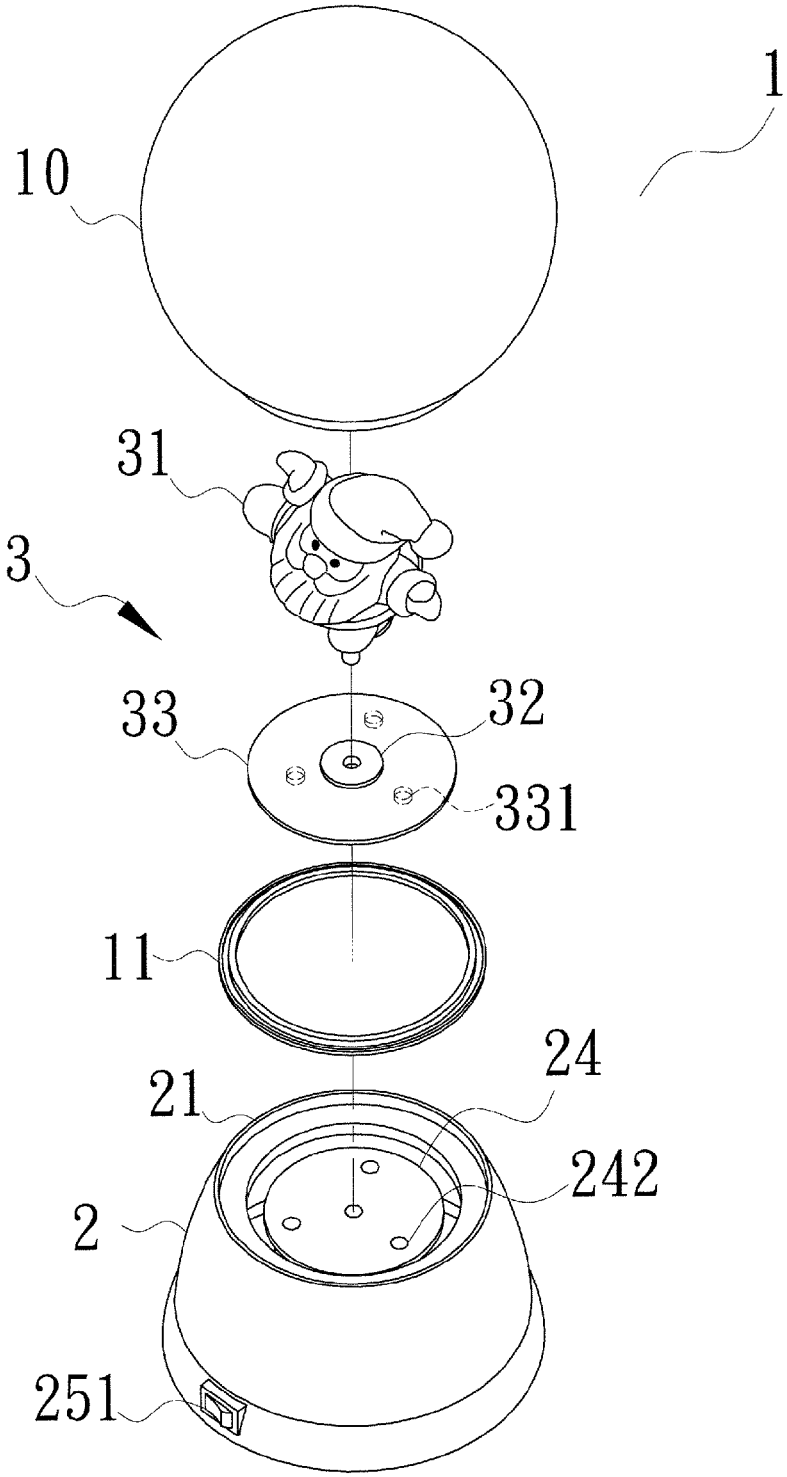
FIG. 1 shows an exploded view of one embodiment of the present invention.
Figure 2:
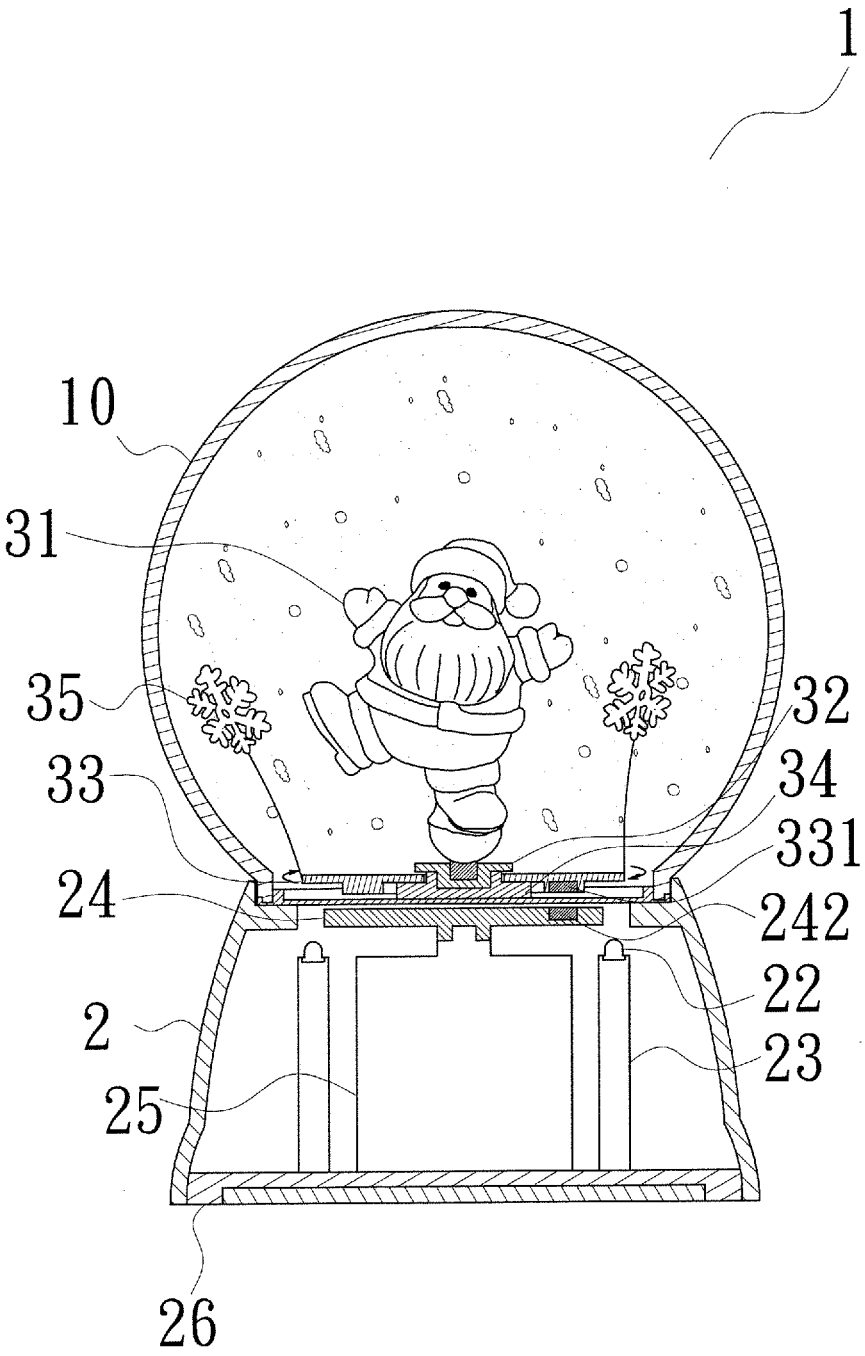
FIG. 2 shows a sectional view of the embodiment of the present invention.
Figure 3:
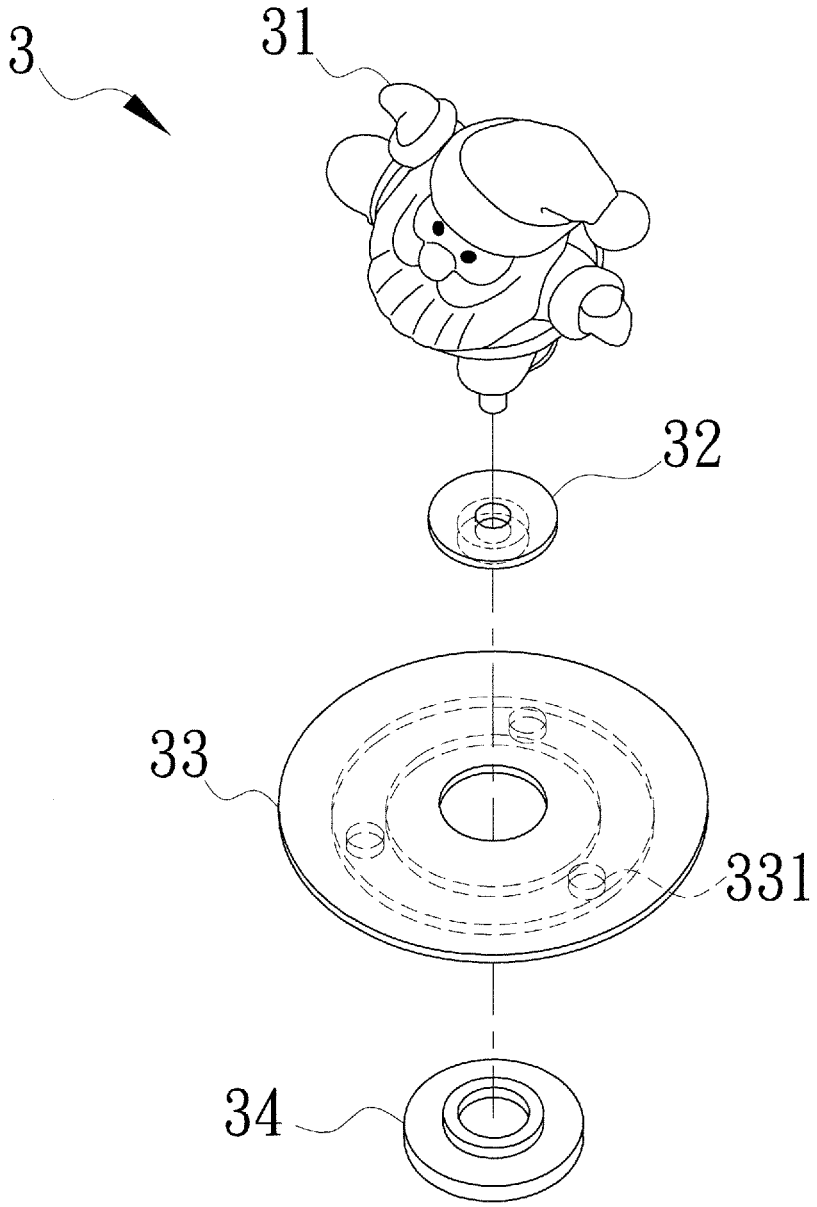
FIG. 3 shows an exploded view of a rotary unit of the embodiment of the present invention.

First of all, referring to FIGS. 1 through 3, a water lamp according to one embodiment of the present invention is shown, which generally comprises a main body 1, a rotary unit 3, and a base 2.

The main body 1, which can be a spherical container, includes a transparent housing 10 and a transparent bottom plate 11, wherein the transparent housing 10 is filled with slightly-viscous flowable liquid through a bottom opening portion thereof, and the transparent bottom plate 11 is used to seal the bottom opening portion of the transparent housing 10. Also, the liquid contained in transparent housing 10 of the main body 1 can be added with sequins or glitter powders.

The rotary unit 3, which is located within the transparent housing 10, includes a 3-D aesthetic object 31, a fixing block 32, a passive disk 33, and a central part 34. The central part 34 is fixedly attached to the transparent bottom plate 11 of the main body 1. The passive disk 33 is rotatably fitted over the central part 34 via a central opening thereof and provided with at least one magnet 331 (there are three magnets 331 shown in FIG. 1). The 3-D aesthetic object 31 is fixed to the fixing block 32 that is in turn fixed to a top of the central part 34 so as to confine the passive disk 33 between the fixing block 32 and the central part. 34

The base 2 defines a top recess 21 corresponding to the bottom opening portion of the transparent housing 10 of the main body 1 for mounting the main body 1. Furthermore, the interior of the base 2 is provided with at least one lighting component 22 facing towards the transparent bottom plate 11 of the main body 1 (there are two lighting components 22 provided shown in FIG. 2), an active disk 24 having at least one magnet 242 corresponding to the magnet 331 of the passive disk 33 (there are three magnets 242 shown in FIG. 1), and a driving device 25 connected to a center of the active disk 24. The lighting component 22, which can be a light-emitting diode (LED) and can be fixed to a top end of a corresponding post 23, is capable of emitting light through the transparent bottom plate 11 to enter the transparent housing 10 of the main body 1 for creating a brilliant visual effect. The driving device 25 can rotate the active disk 24, which in turn can rotate the passive disk 33 by using mutual attraction between the magnet 242 of the active disk 24 and the magnet 331 of the passive disk 33. Furthermore, a plurality of ornamental objects 35 are provided at a circumference of the passive disk 33 at intervals and thus can be moved through rotation of the passive disk 33.

Furthermore, a switch 251 can be provided at the base 2 for electrically connecting the driving device 25 to a power supply for controlling the activation of the driving device 25 for rotating the active disk 24 and thus rotating the passive disk 33 through the magnets 242, 331 of the active disk 24 and the passive disk 33. Also, the switch 251 can be used to electrically connect the lighting component 22 to the power supply for controlling the lighting component 22. The power supply for the driving device 25 and the lighting component 22 can be a battery, a public power source, or other power sources.

Figure 4:
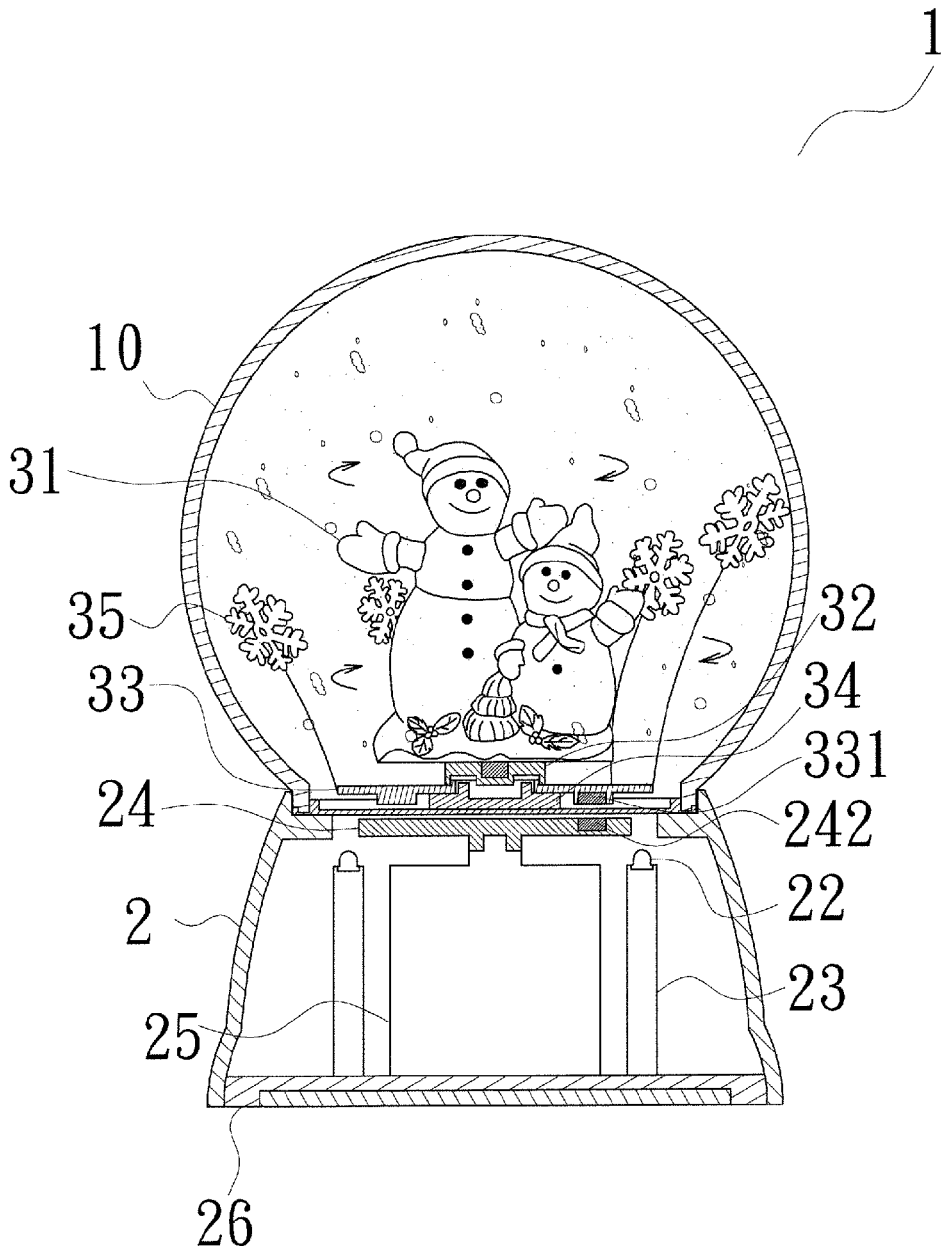
FIG. 4 shows a working view of the embodiment of the present invention.

The fixing block 32 can be firmly engaged with the passive disk 33 and thus can be rotated with the passive disk 33. Therefore, the 3-D aesthetical body 31 fixed on the fixing block 32 can be rotated with the passive disk 33 to give more visual feel, as shown in FIG. 4. In assembling the water lamp, the driving device 25 and the post 23 can be mounted on a mounting plate 26 provided at a bottom of the base 2, wherein the post 23 is located near a periphery of the driving device 25. Next, the switch 251 can be provided at the base 2 and electrically connected to the driving device 25 for controlling the activation of the driving device 25. The lighting component 22, which can be a light-emitting diode, can be fixed to the post 23 and electrically connected to the switch 251. Finally, the bottom opening portion of the main body 1 being provided with the rotary unit 3 and filled with liquid therein can be mounted to the top recess 21 of the base 2, wherein the magnet 331 of the passive disk 33 is located corresponding to the magnet 242 of the active disk 24.

Since the 3-D aesthetical object 31 or the ornamental objects 35 can be rotated or moved by the passive disk 33, these objects can disturb the liquid contained in the main body 1, so that the sequins or glitter powders, which have fallen to the bottom of the main body 1, can be moved.

Thus, when the switch 251 is switched on, the driving device 25 can rotate the active disk 24, which in turn can rotate the passive disk 33 through the magnets 242 of the active disk 24 and the magnets 331 of the passive disk 33, so that the 3-D aesthetical object 31 or the ornamental objects 35 can be moved to cause the liquid contained in the transparent housing 10 to flow. At the same time, the lighting component 22, which is located corresponding to the bottom opening portion of the transparent housing 10, can emit light into the transparent housing 10 to produce a more brilliant visual effect.

In conclusion, the present invention has the following advantages:

1. The interior of the base 2 is provided with a lighting component corresponding to the bottom opening portion of the transparent housing 10 of the main body 1, so that a more brilliant visual effect can be created.

2. The interior of the transparent housing 10 of the main body 1 is provided with a rotary unit which can move the ornamental objects 35 or rotate the 3-D aesthetic object 31 to disturb the liquid and the sequins or glitter powders contained in the transparent housing 10, so that a dynamic visual effect can be created.

In light of the foregoing, the present invention can create a brilliant visual effect through a lighting component thereof and, more particularly, can create a dynamic visual effect through a rotary unit thereof. Thus, the present invention is an innovative creation for decoration.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A water lamp, comprising:

a main body including a transparent housing and a transparent bottom plate, wherein the transparent housing is filled with flowable liquid through a bottom opening portion thereof, and the transparent bottom plate is used to seal the bottom opening portion of the transparent housing;

a rotary unit located within the transparent housing and including an aesthetic object, a fixing block, a passive disk that is separate from the fixing block, and a central part, wherein the central part is fixedly attached to the transparent bottom plate of the main body, the passive disk comprises a central opening that is rotatably fitted over the central part to allow the passive disk to be rotatable about the central part and is provided with at least one magnet, and the aesthetic object is fixed to the fixing block that is in turn fixed to the central part so as to confine the passive disk between the fixing block and the central part; and a base defining a top recess corresponding to the bottom opening portion of the transparent housing of the main body for mounting the main body, the base being provided with a lighting component facing towards the transparent bottom plate of the main body, an active disk having at least one magnet corresponding to the magnet of the passive disk, and a driving device connected to a center of the active disk, whereby the lighting component emits light through the transparent bottom plate to enter the transparent housing of the main body, and the driving device rotates the active disk, which in turn rotates the passive disk by using mutual attraction between the magnet of the active disk and the magnet of the passive disk;

wherein a plurality of ornamental objects is provided at a circumference of the passive disk at intervals and is thus rotatable in unison with the passive disk with respect to the central part to as to be rotatably received in the transparent housing, while the aesthetic object is fixed via the fixing block to the central part so as to be located within the transparent housing.

2. The water lamp of claim 1, wherein the fixing block is firmly engaged with the passive disk and thus rotates with the passive disk.

3. The water lamp of claim 1, wherein the lighting component is a light-emitting diode (LED).

* * * * *